US011206474B2

(12) United States Patent
Yuen et al.

(10) Patent No.: US 11,206,474 B2
(45) Date of Patent: Dec. 21, 2021

(54) BLUETOOTH HEADSET

(71) Applicant: Innovation Sound Technology Co., LTD., Guangdong (CN)

(72) Inventors: Shunming Yuen, Guangdong (CN); Lei Zheng, Guangdong (CN); Chun Lan, Guangdong (CN)

(73) Assignee: INNOVATION SOUND TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/605,474

(22) PCT Filed: Jan. 25, 2018

(86) PCT No.: PCT/CN2018/074125
§ 371 (c)(1),
(2) Date: Oct. 15, 2019

(87) PCT Pub. No.: WO2019/144338
PCT Pub. Date: Aug. 1, 2019

(65) Prior Publication Data

US 2021/0281939 A1 Sep. 9, 2021

(51) Int. Cl.
*H04R 1/10* (2006.01)
*H04R 1/02* (2006.01)
*H04R 1/08* (2006.01)

(52) U.S. Cl.
CPC ..... *H04R 1/1016* (2013.01); *H04R 1/023* (2013.01); *H04R 1/08* (2013.01); *H04R 1/105* (2013.01);
(Continued)

(58) Field of Classification Search
CPC ..... H04R 1/1016; H04R 1/023; H04R 1/08; H04R 1/1025; H04R 1/1041; H04R 1/105; H04R 1/1058; H04R 2420/07
(Continued)

(56) References Cited

U.S. PATENT DOCUMENTS 7,620,173 B1 * 11/2009 Wilson ..... H04R 1/08 379/430
8,600,095 B2 * 12/2013 Yuen ..... H04R 1/1041 381/380
(Continued)

FOREIGN PATENT DOCUMENTS

CN 101203058 A 6/2008
CN 102647649 A 8/2012
(Continued)

OTHER PUBLICATIONS

International Search Report for PCT/CN2018/074125, dated Oct. 10, 2018; English translation submitted herewith (5 pgs.).

*Primary Examiner* — David L Ton
(74) *Attorney, Agent, or Firm* — Fitch, Even, Tabin & Flannery, LLP

(57) ABSTRACT

The utility model relates to a Bluetooth earphone, comprising a main earphone unit and an auxiliary earphone unit, further comprising a pair of ear hooks. The front part of the inner side of each of the said earphone units is provided with a connecting canal for inserting the said vertical insertion segment at the bottom. The Bluetooth earphone provided in the utility model not only adapts to applications in different situations by setting a pluggable ear hook, but also uses memory alloy as the inner skeleton of the ear hook to facilitate a user make a fine adjustment by his/her shape of auricle.

6 Claims, 10 Drawing Sheets

(52) U.S. Cl.
CPC ..... *H04R 1/1025* (2013.01); *H04R 1/1041* (2013.01); *H04R 1/1058* (2013.01); *H04R 2420/07* (2013.01)

(58) Field of Classification Search
USPC ..... 381/74
See application file for complete search history.

(56) References Cited

U.S. PATENT DOCUMENTS

| | | | | |
|---|---|---|---|---|
| 10,154,334 | B1 * | 12/2018 | Lin | H04R 1/1041 |
| 2006/0147078 | A1 * | 7/2006 | Neu | H04R 3/00 381/374 |
| 2007/0172091 | A1 * | 7/2007 | Tsai | H04R 1/1025 381/381 |
| 2008/0132292 | A1 * | 6/2008 | Hansen | H04R 1/1066 455/569.1 |
| 2008/0232632 | A1 * | 9/2008 | Liu | H04R 1/1066 381/381 |
| 2009/0103768 | A1 * | 4/2009 | Lin | H04R 1/1058 381/390 |
| 2009/0116678 | A1 * | 5/2009 | Bevirt | H04M 1/05 381/381 |
| 2012/0039500 | A1 * | 2/2012 | Silvestri | H04R 1/02 381/380 |
| 2014/0334658 | A1 * | 11/2014 | Wang | B29C 45/14549 381/381 |
| 2015/0172804 | A1 * | 6/2015 | Armstrong | H04R 1/1058 381/380 |
| 2016/0014492 | A1 * | 1/2016 | McCarthy | H04R 1/1091 381/74 |
| 2017/0195770 | A1 * | 7/2017 | Cheney | H04R 1/105 |
| 2018/0270558 | A1 * | 9/2018 | Ring | H04R 1/1091 |
| 2018/0275950 | A1 * | 9/2018 | Takagi | A61B 5/6803 |

FOREIGN PATENT DOCUMENTS

| | | | |
|---|---|---|---|
| CN | 107454492 | A | 12/2017 |
| CN | 206993344 | U | 2/2018 |
| JP | 2001-346287 | A | 12/2001 |
| JP | 2005-318342 | A | 11/2005 |

* cited by examiner

BLUETOOTH HEADSET

CROSS-REFERENCE TO RELATED APPLICATIONS

This application is a U.S. national phase application filed under 35 U.S.C. § 371 of International Application No. PCT/CN2018/074125, filed Jan. 25, 2018, designating the United States, the entire contents of which are hereby incorporated herein by reference.

FIELD OF THE INVENTION

The utility model relates to an earphone, in particular to a Bluetooth earphone.

BACKGROUND OF THE INVENTION

Conventional wired head earbuds/earphones are basically composed of a sounding unit and earphone signal cords used to connect to a signal source and to function to transmit audio signals. Although the signal stability in transmission can be ensured due to the presence of signal cords, some disadvantages are also caused by their own characteristics such as a fixe length, the need to be connected to a dedicated jack (occupying the number of reserved jacks on the device) before use, a tendency to tangle and knot, the production of a receiver effect.

With the development of Bluetooth wireless transmission technology and people's instinct to get rid of restraint, more and more Bluetooth headsets with high transmission bandwidth and high transmission stability appear on the market. These Bluetooth headsets are roughly divided into two categories. One is a two-channel music earphone with the sound quality as a selling point, having a pair of sounding units. The other is an earphone convenient for talking after being connected with a mobile phone. Most earphones only have one sounding unit in this case.

In addition, in order to cope with the situation where large amplitude of vibration during outdoor activities readily causes an earphone to fall off, an ear hook is connected to the casing of a Bluetooth earphone (a sounding unit). The traditional ear-wear Bluetooth earphone is fixed to human ears via a hook for stable wear. However, people do not always stay outdoors, and they spend a considerable part of time sitting quiet indoors or in cars, so this type of ear-wear Bluetooth headset exposes its shortcomings. On the one hand, the ear-wear Bluetooth headset is not easy to wear, and it may cause pain and discomfort to human ears after being hang for a long time. On the other hand, since each person's ear shape is not the same, and the shape of an ear hook is mostly the same, it is not perfectly adapted to all users.

Content of Utility Model

The utility model is intended to solve the above technical problem by proposing a Bluetooth earphone with better adaptability to human ears and different product forms for static and dynamic use states.

The technical solution proposed by the utility model relates to a Bluetooth earphone, comprising a main earphone unit and an auxiliary earphone unit, further comprising a pair of ear hooks, which are made of a nickel-titanium alloy memory wire, a pair of plastic sleeves respectively placed on both ends of the said nickel-titanium alloy memory wire, and silicone components integrally cladded on the said nickel-titanium alloy memory wire and on the outside of the plastic sleeves, and comprise a vertical insertion segment, and an arc-shaped hook extending from behind the top of the said vertical insertion segment;

A connecting canal for inserting the said vertical insertion segment at the bottom is formed at the front portion of inner side surface of each of the said earphone units;

A depressed hook groove is formed in the sidewall surface at the near bottom end of the said vertical insertion segment. A convex rim for inserting into the said hook groove is formed at a predetermined position of the hole wall for the said connecting canal. The said rim is a guiding slope extending onto the wall of the said connecting canal on the side facing the opening of the connecting canal. A curved chamfer is formed at the circumferential edge of the bottom end of the said vertical insertion segment.

Further, each of the said earphone units is composed of a front cover for switch button, an outer frame for ear cup, a main control circuit board, a battery, a back cover for ear cup, a speaker back cover, a speaker, a speaker front cover, and a seal gland for sound regulation;

The said main control circuit board is provided with a pickup microphone, a Bluetooth SOC, a decoding module, a speaker drive module, a charge management module, and a control button.

The outer frame for the said ear cup is connected to an outer opening in the back cover for the said ear cup; the said main control circuit board and the said battery are disposed in a cavity surrounded by the outer frame for the said ear cup and the back cover for the said ear cup; a pickup hole positioned opposite to the position of a pickup microphone is disposed in the outer frame for the said ear cup; the front cover for the said switch button is movably disposed in an outer opening of the outer frame for the said ear cup, and coupled to a control button on the said main control circuit board; the said speaker back cover is connected to the rear side of the back cover for the said ear cup; the said speaker is disposed in the said speaker back cover, and mounted with a front cover in its front hood; the said speaker front cover has a forwardly extending and length-predetermined sound guiding tube, to which the said seal gland for sound regulation is connected;

The said connecting canal is surrounded by an arched curve surface formed by a forward bulge of the front end of inner side of the said back cover for ear cup.

Further, at least one sound-regulating hole is disposed in the said speaker front cover and the said speaker back cover respectively.

Further, waterproof sound-regulating mesh fabric is attached to the inner aperture of the said sound regulating hole, and sound-regulating mesh fabric is also disposed at the front end of the said sound guiding tube.

Further, waterproof sound-regulating mesh fabric is attached to the inner opening of the said pickup hole.

Further, it also comprises a waterproof cover, which is fastened at an opening of the said connecting canal horizontally toward the battery.

The beneficial effects of the utility model are:

The Bluetooth earphone provided in the utility model not only adapts to applications in different situations by setting a pluggable ear hook, but also uses memory alloy as the inner skeleton of the ear hook to facilitate a user make a fine adjustment by his/her shape of auricle.

In addition, traditional Bluetooth earphones are improved in sound quality by a combination and adjustment of sound-regulating hole, sound-guiding tube, sound-guiding cloth and sound-guiding sleeve, and have a better frequency response curve.

Instruction on accompanying drawings

The Bluetooth headset involved in the utility model is further described below with reference to the accompanying drawings.

Concrete Ways of Implementation

Figure 1:
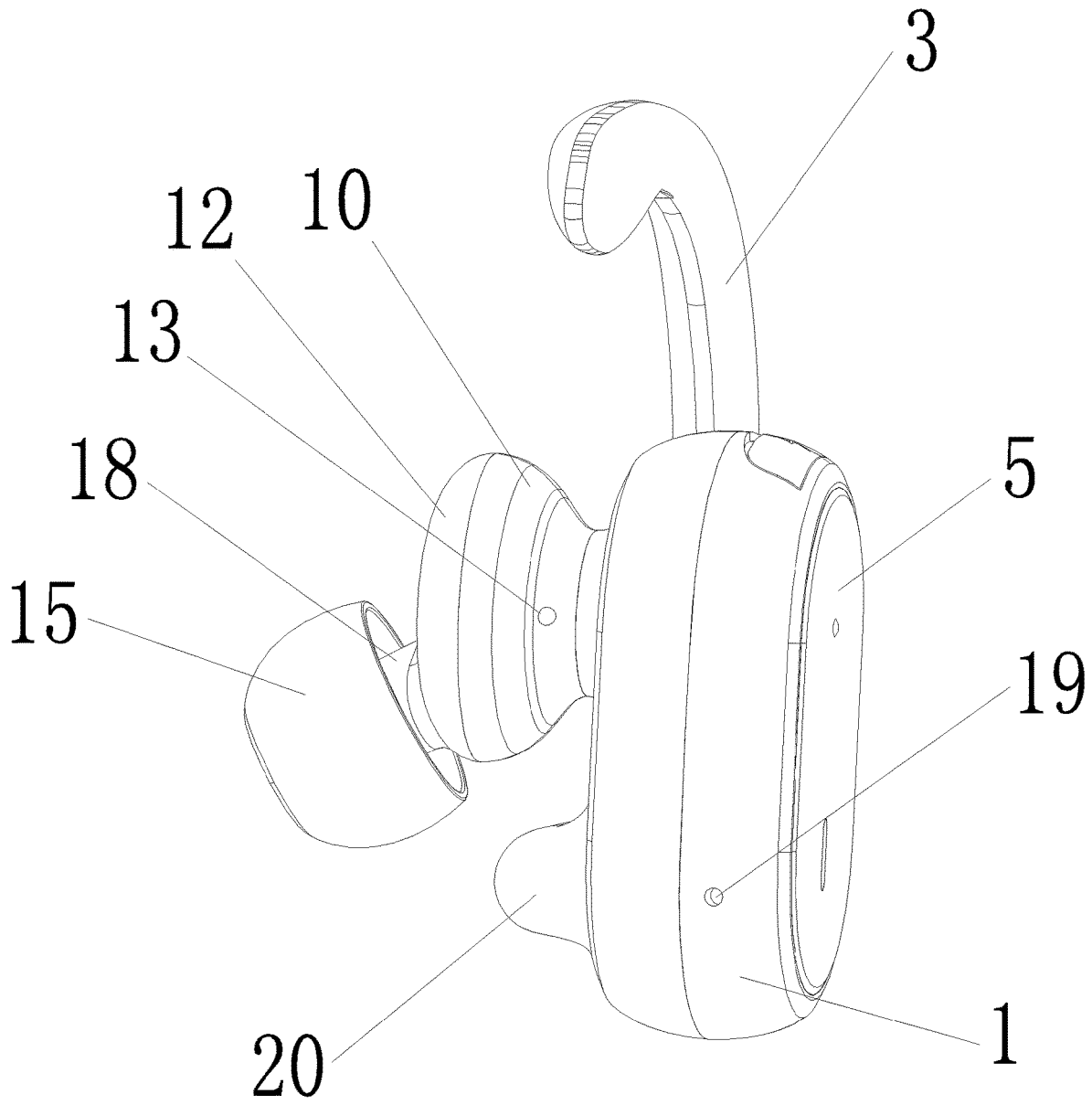
FIG. 1 is a three-dimensional structure diagram of the main earphone unit in the utility model.
Figure 2:
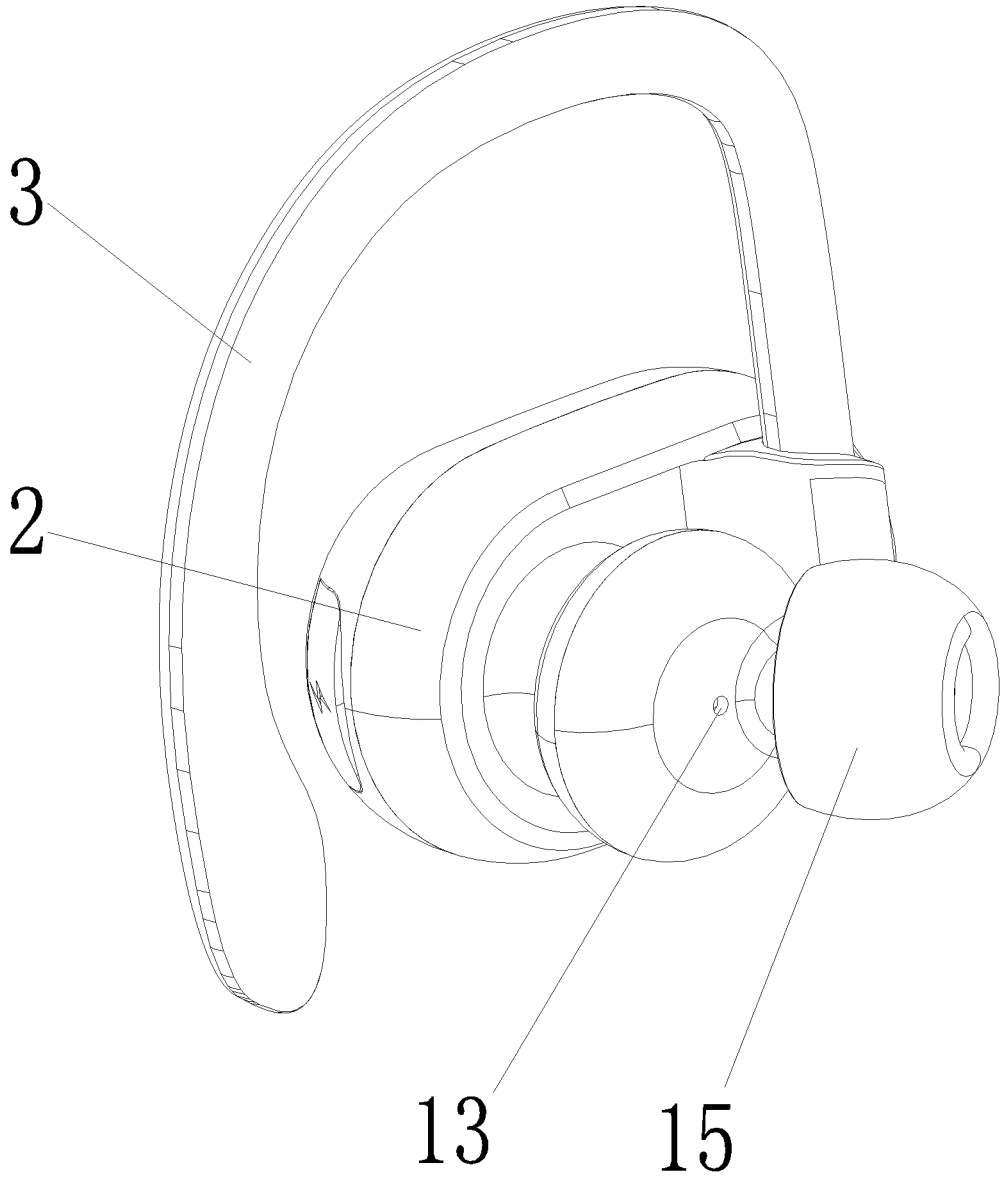
FIG. 2 is a three-dimensional structure diagram of the auxiliary earphone unit in the utility model.
Figure 3:
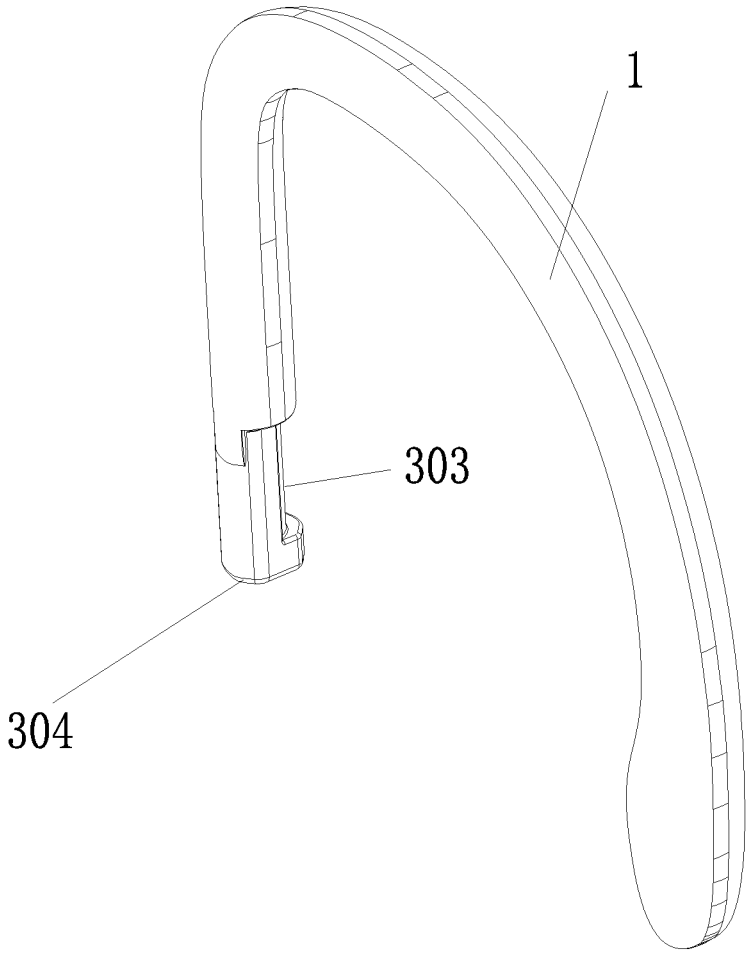
FIG. 3 is a structure diagram of the ear hook in the utility model.
Figure 4:
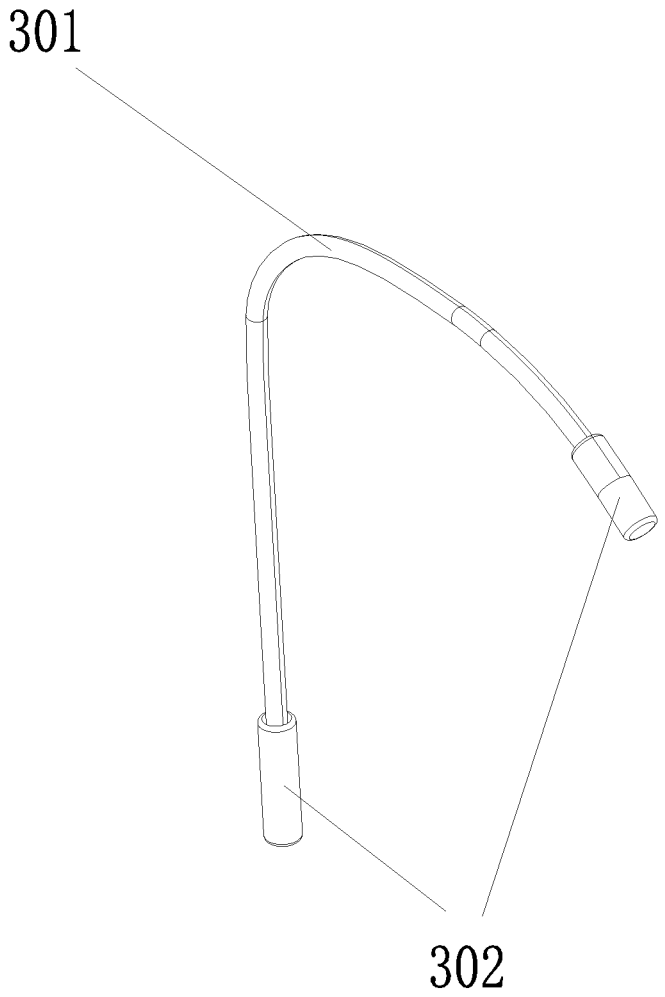
FIG. 4 is a structure diagram of the nickel-titanium alloy memory wire and plastic sleeve.
Figure 5:
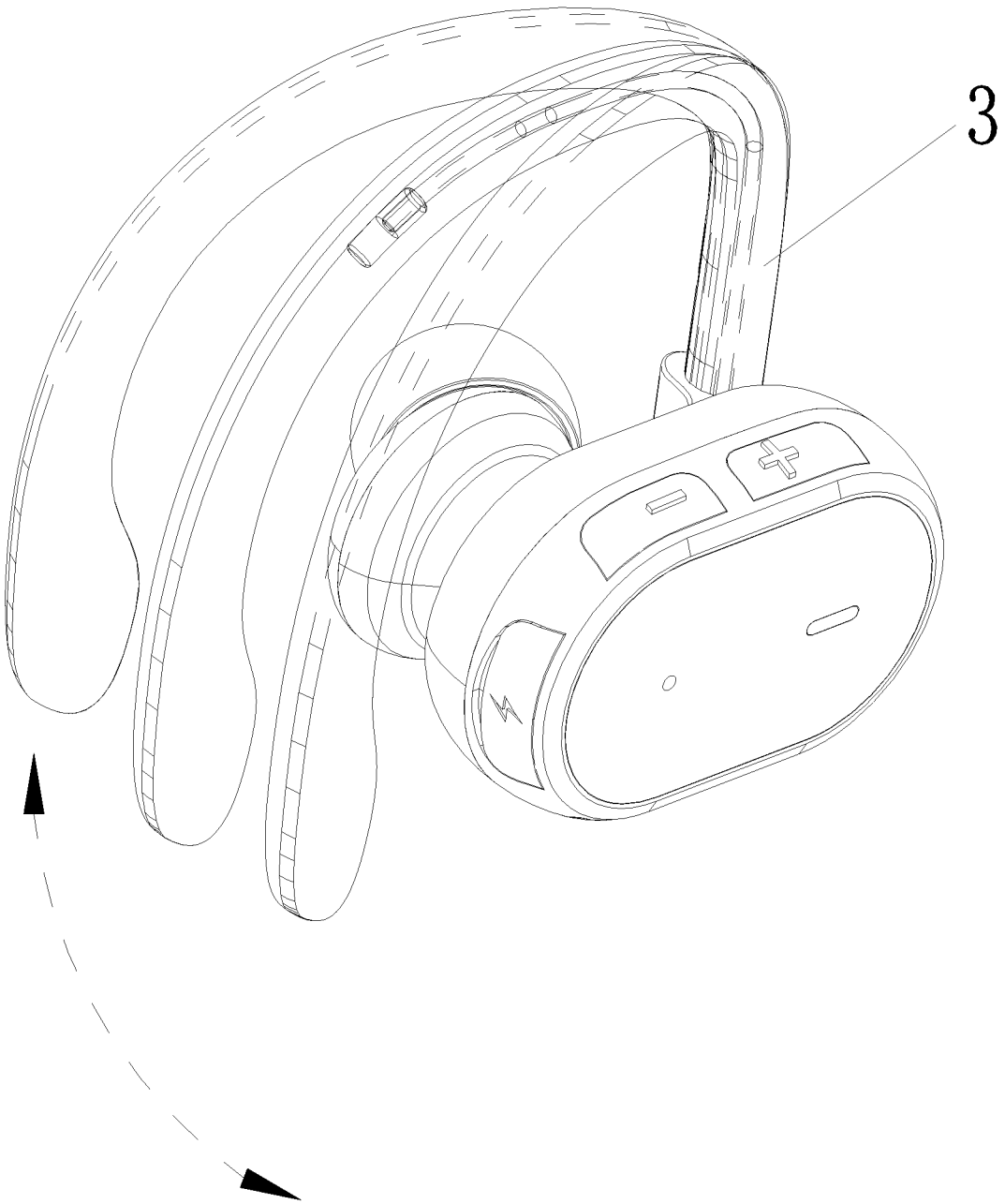
FIG. 5 is a diagram for the adjustment of the ear hook in the utility model.
Figure 6:
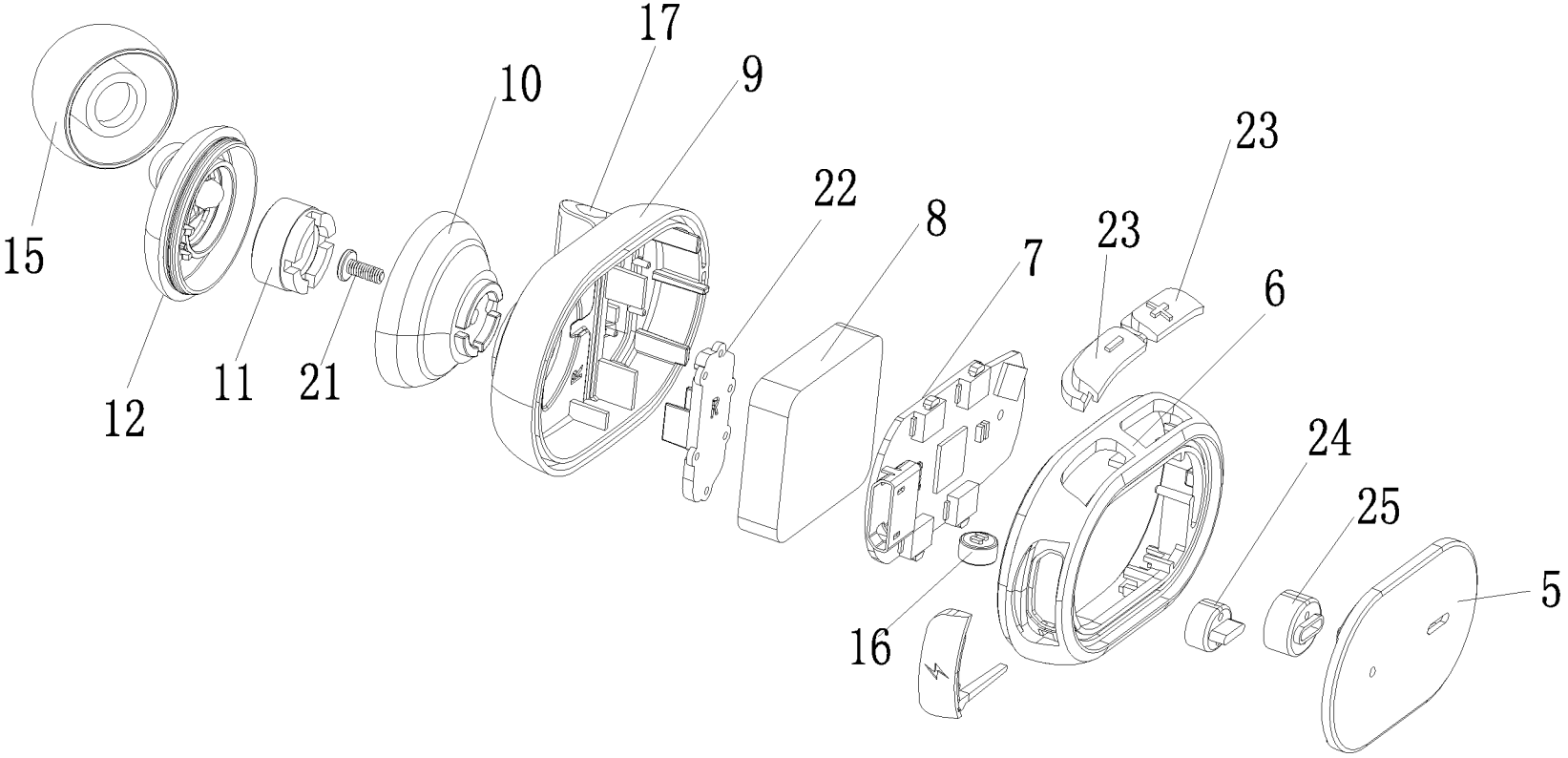
FIG. 6 is an exploded structure view of the main earphone unit in the utility model.
Figure 7:
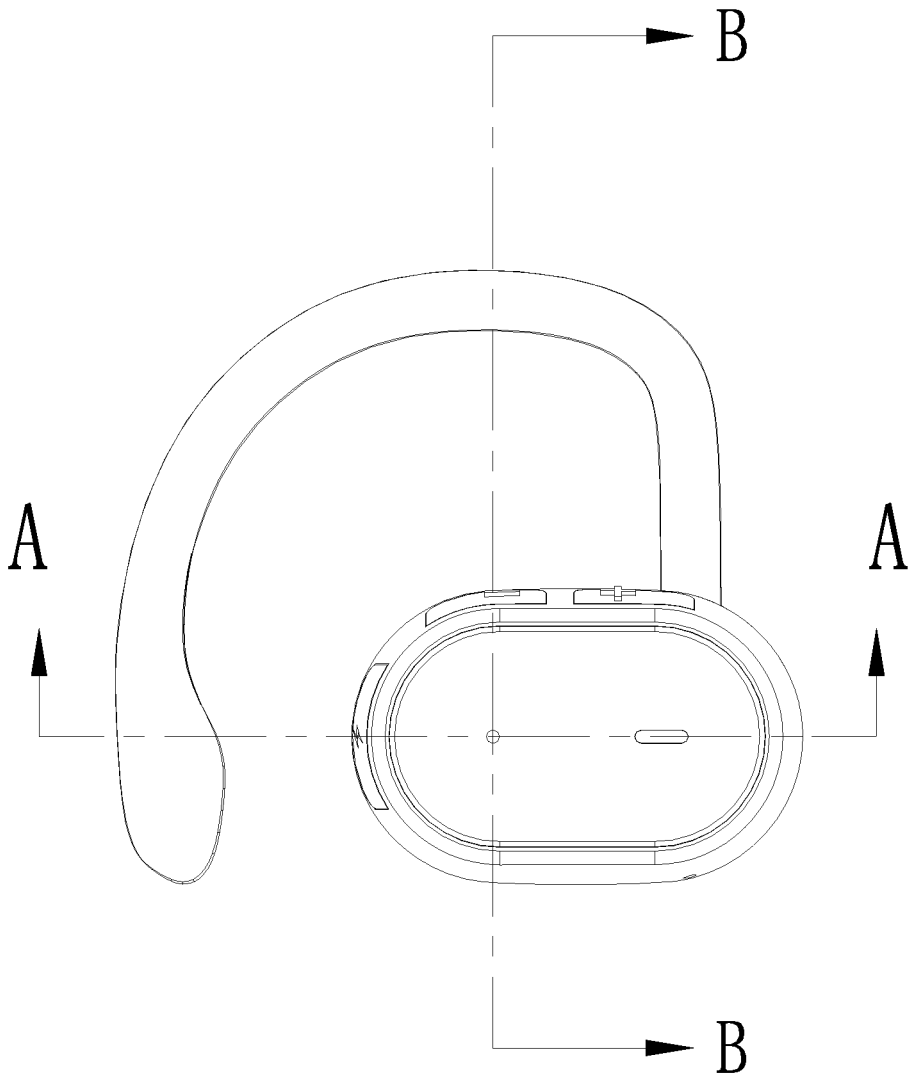
FIG. 7 is a lateral view of the main earphone unit in the utility model.
Figure 8:
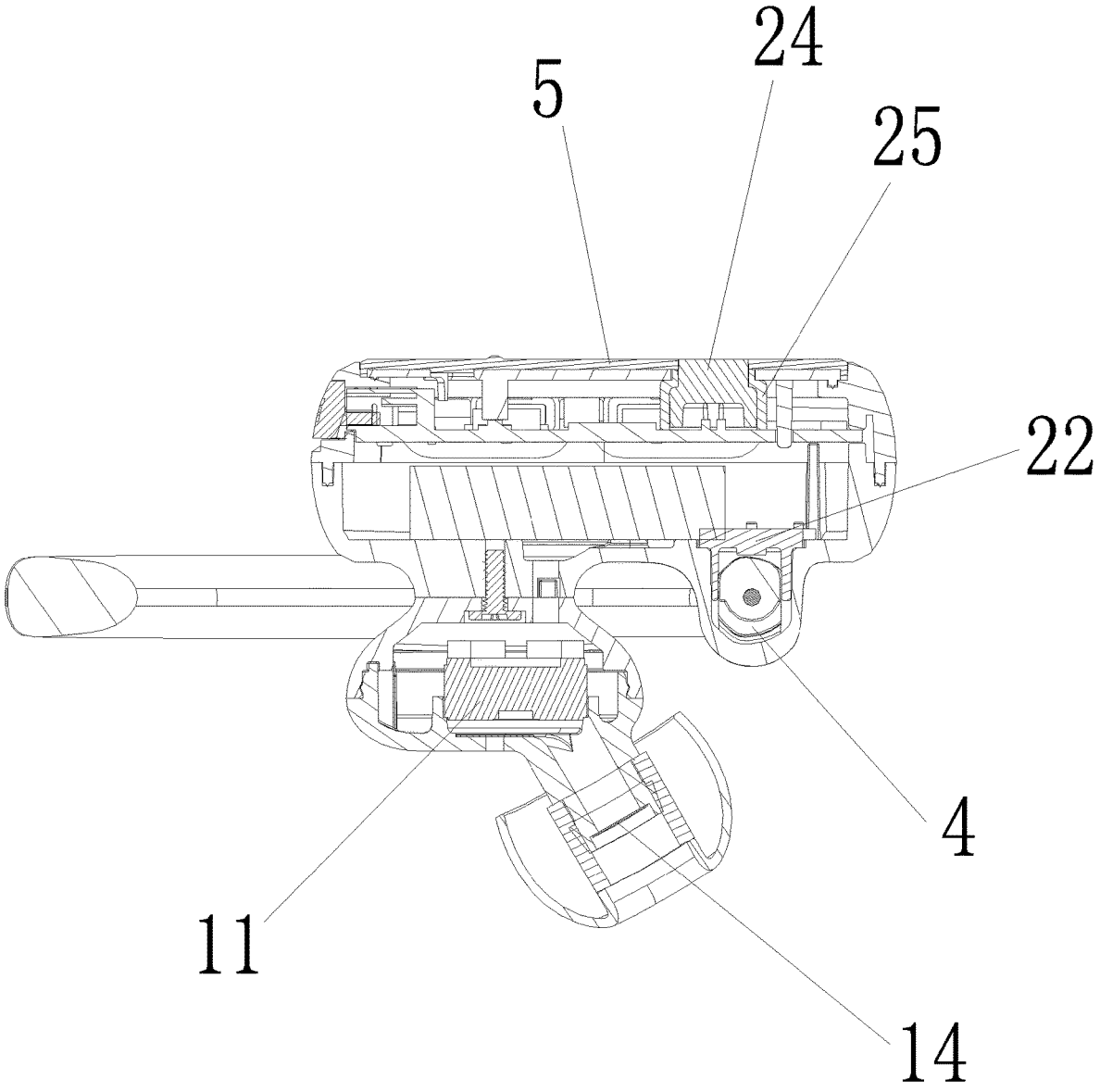
FIG. 8 is a cross-sectional structure view of the main earphone unit shown in FIG. 7 in the direction of A-A.
Figure 9:
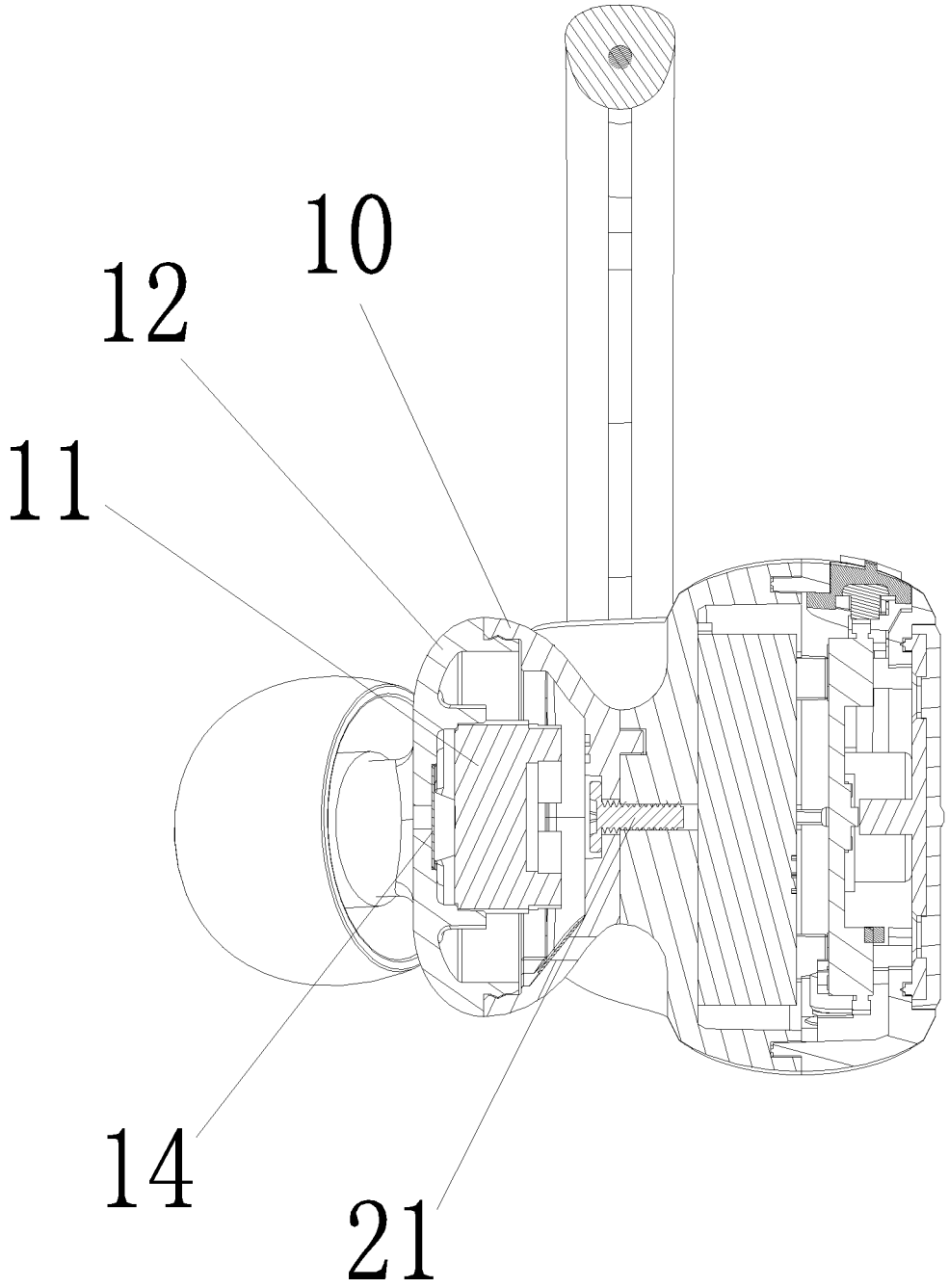
FIG. 9 is a cross-sectional structure view of the main earphone unit shown in FIG. 7 in the direction of B-B.
Figure 10:
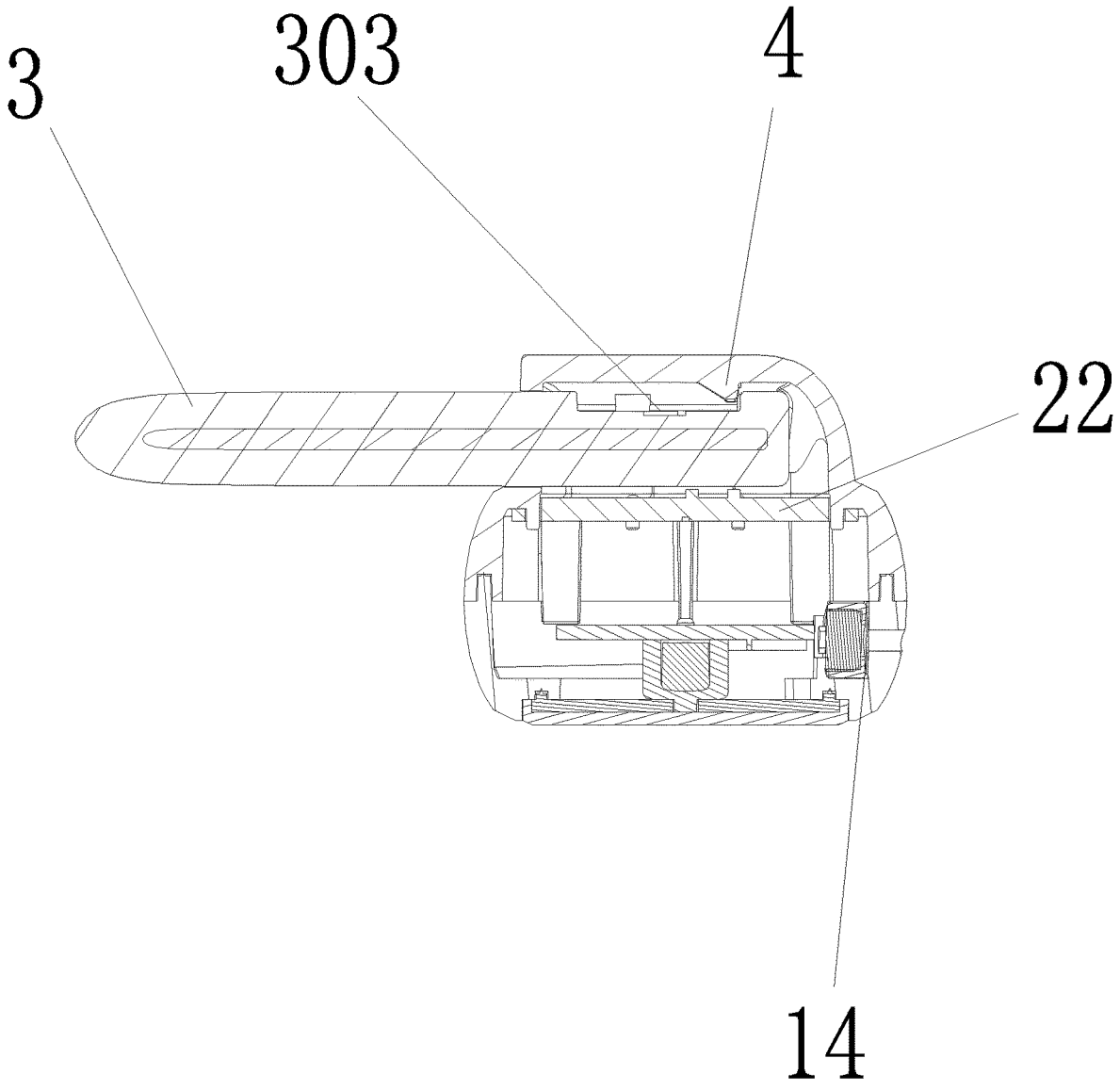
FIG. 10 is a structure diagram of any earphone unit with its ear hook inserted in the utility model.

As shown in FIGS. 1 and 2, the Bluetooth headset involved in the utility model comprises a main earphone unit 1 and an auxiliary earphone unit 2, and further comprises a pair of ear hooks 3. The integral structure of the main and auxiliary earphone units 1 and 2 forms mirror images with each other.

As shown in FIGS. 3, 4, 5, 6, 7, 8, 9 and 10, ear hooks 3 is composed of a nickel-titanium alloy memory wire 301, a pair of plastic sleeves 302 respectively placed on both ends of the nickel-titanium alloy memory wire 301, and silicone components integrally cladded on the said nickel-titanium alloy memory wire 301 and on the outside of the plastic sleeves 302, and comprise a vertical insertion segment, and an arc-shaped hook extending from behind the top of the said vertical insertion segment.

The front part of the inner side of each of the earphone units is provided with a connecting canal 17 for insertion of the vertical insertion segment at the bottom.

A depressed hook groove 303 is formed in the sidewall surface at the near bottom end of the vertical insertion segment. A convex rim 4 for inserting into the hook groove 303 is formed at a predetermined position of the hole wall for the connecting canal 17. The rim 4 is a guiding slope extending onto the wall of the connecting canal 17 on the side facing the opening of the connecting canal 17. A curved chamfer 304 is formed at the circumferential edge of the bottom end of the vertical insertion segment.

Each of the earphone units is composed of a front cover 5 for switch button, an outer frame 6 for ear cup, a main control circuit board 7, a battery 8, a back cover 9 for ear cup, a speaker back cover 10, and a speaker 11, a speaker front cover 12 and a seal gland 15 for sound regulation;

The main control circuit board 7 is provided with a pickup microphone 16, a Bluetooth SOC, a decoding module, a speaker drive module, a charge management module, and a control button.

The outer frame for ear cup 6 is connected to the outer opening of the back cover for ear cup 9. The main control circuit board 7 and the battery 8 are disposed in a cavity surrounded by the outer frame for ear cup 6 and the back cover for ear cup 9. Disposed on the outer frame for ear cup 6 is pickup hole 19 positioned opposite to the position of pickup microphone 16. Preferably, waterproof sound-regulating mesh fabric 14 is attached to the inner opening of pickup hole 19.

The front cover for switch button may be movably disposed in an outer opening of the outer frame for ear cup 6, and coupled to a control button on main control circuit board 7.

The speaker back cover 10 is connected to the rear side of the back cover for ear cup 9. The speaker 11 is disposed in the speaker back cover 10, and mounted with a front cover in its front hood. The speaker 11 front cover has a forwardly extending and length-predetermined sound guiding tube, to which the seal gland for sound regulation is connected. Preferably, the speaker back cover 10 is connected to the back cover for ear cup 9 with screws 21.

Preferably, it also comprises a waterproof cover 22, which is fastened at an opening of the connecting canal 17 horizontally toward the battery 8.

The connecting canal 17 is surrounded by an arched curve surface 20 formed by a forward bulge of the front end of inner side of the back cover for ear cup 9.

At least one sound-regulating hole 13 is disposed in the speaker front cover 10 and the speaker back cover 12 respectively. Waterproof sound-regulating mesh fabric 14 is attached to the inner aperture of the sound regulating hole 13, and sound-regulating mesh fabric 14 is also disposed at the front end of the sound guiding tube 18.

Preferably, the main control circuit board 7 is provided with LED particles, and the front cover for switch button 5 is provided with a through hole. It further includes an LED light column 24 for being disposed on the LED particles as well as a protective sleeve 25 for being placed on the LED light column. It is also preferable that the volume adjustment key 23 is provided on the outer frame for ear cup 6 of the main earphone unit 1, made of TPE+ABS757 material and subjected to waterproof treatment on the inner surface thereof.

The utility model is not limited to the above embodiment. The technical solutions for the above various embodiments involved in the utility model can be cross-combined with each other to form a new technical solution. In addition, the technical solutions formed by the equivalent replacement all fall within the protection scope required by the utility model.

The invention claimed is:

1. A Bluetooth earphone comprising:

a main earphone unit;

an auxiliary earphone unit;

a pair of ear hooks, which are made of a nickel-titanium alloy memory wire, a pair of plastic sleeves respectively placed on both ends of the nickel-titanium alloy memory wire, and silicone components integrally cladded on the nickel-titanium alloy memory wire and on the outside of the plastic sleeves, and comprise a vertical insertion segment, and an arc-shaped hook extending from behind the top of the vertical insertion segment;

wherein a connecting canal for inserting the vertical insertion segment at the bottom is formed at the front portion of inner side surface of each of the earphone units; and a depressed hook groove is formed in a sidewall surface at the near bottom end of the vertical insertion segment, a convex rim for inserting into the hook groove is formed at a predetermined position of the hole wall for the connecting canal, the rim is a guiding slope extending onto the wall of the connecting canal on the side facing the opening of the connecting canal, and a curved chamfer is formed at the circumferential edge of the bottom end of the vertical insertion segment.

2. The Bluetooth earphone according to claim 1, wherein:

each of the earphone units is composed of a front cover for switch button, an outer frame for ear cup, a main control circuit board, a battery, a back cover for ear cup, a speaker back cover, and a speaker, a speaker front cover and a seal gland for sound regulation;

the main control circuit board is provided with a pickup microphone, a Bluetooth SOC, a decoding module, a speaker drive module, a charge management module, and a control button, the outer frame for the ear cup is connected to an outer opening in the back cover for the ear cup; the main control circuit board and the battery are disposed in a cavity surrounded by the outer frame for the ear cup and the back cover for the ear cup;

a pickup hole positioned opposite to the position of a pickup microphone is disposed in the outer frame for the ear cup; the front cover for the switch button is movably disposed in an outer opening of the outer frame for the ear cup, and coupled to a control button on the main control circuit board; the speaker back cover is connected to the rear side of the back cover for the ear cup; the speaker is disposed in the speaker back cover, and mounted with a front cover in its front hood; the speaker front cover has a forwardly extending and length-predetermined sound guiding tube, to which the seal gland for sound regulation is connected, and the connecting canal is surrounded by an arched curve surface formed by a forward bulge of the front end of inner side of the back cover for ear cup.

3. The Bluetooth earphone according to claim 2, wherein at least one sound-regulating hole is disposed in the speaker front cover and the speaker back cover respectively.

4. The Bluetooth earphone according to claim 3, wherein a waterproof sound-regulating mesh fabric is attached to the inner aperture of the sound regulating hole, and sound-regulating mesh fabric is also disposed at the front end of the sound guiding tube.

5. The Bluetooth earphone according to claim 2, wherein a waterproof sound-regulating mesh fabric is attached to the inner opening of the pickup hole.

6. The Bluetooth earphone according to claim 2, further comprising a waterproof cover, which is fastened at an opening of the connecting canal horizontally toward the battery.

* * * * *